US005630630A

United States Patent [19]

Price et al.

[11] Patent Number: 5,630,630

[45] Date of Patent: May 20, 1997

[54] GLOVE COMPARTMENT LATCH MECHANISM

[75] Inventors: Robert J. Price, Oconomowoc; John E. Bailen, West Allis, both of Wis.

[73] Assignee: Strattec Security Corporation, Milwaukee, Wis.

[21] Appl. No.: 500,629

[22] Filed: Jul. 11, 1995

[51] Int. Cl.[6] ..... E05B 19/12

[52] U.S. Cl. ..... 292/128; 292/336.3; 292/DIG. 30

[58] Field of Search ..... 292/128, 101, 292/336.3, DIG. 30, DIG. 70, 122, DIG. 31; 70/258, 84

[56] References Cited

U.S. PATENT DOCUMENTS

| | | | |
|---|---|---|---|
| 2,640,723 | 6/1953 | Lauer et al. | 296/37 |
| 3,581,532 | 6/1971 | Anderson et al. | 70/84 |
| 3,782,139 | 1/1974 | Rubner | 70/81 |
| 4,343,501 | 8/1982 | Meeks | 292/336.3 |
| 4,630,857 | 12/1986 | Zweiniger et al. | 296/37 |
| 4,781,407 | 11/1988 | Rauchhaus | 292/37 |
| 4,850,208 | 7/1989 | Weinerman et al. | 70/208 |
| 4,886,311 | 12/1989 | Trube et al. | 296/37 |
| 5,098,141 | 3/1992 | Bull | 292/252 |
| 5,190,314 | 3/1993 | Takasugi | 280/752 |
| 5,292,159 | 3/1994 | Sandhu et al. | 292/173 |
| 5,484,178 | 1/1996 | Sandhu et al. | 292/173 |

*Primary Examiner*—Steven N. Meyers
*Assistant Examiner*—Donald J. Lecher
*Attorney, Agent, or Firm*—Andrus, Sceales, Starke & Sawall

[57] ABSTRACT

A latch mechanism for a glove compartment is provided. The latch mechanism includes a plate mountable to the door of the glove compartment. A lever and a hook are interlocked to each other and pivotably mounted to the plate. The lever is movable between a closed position and an opened position such that movement of the lever from the closed position to the opened position pivots the hook and consequently unlatches the latch mechanism for the glove compartment. When the lever is in the closed position, the hook may be pivoted independent of the lever.

19 Claims, 2 Drawing Sheets

FIG. 3
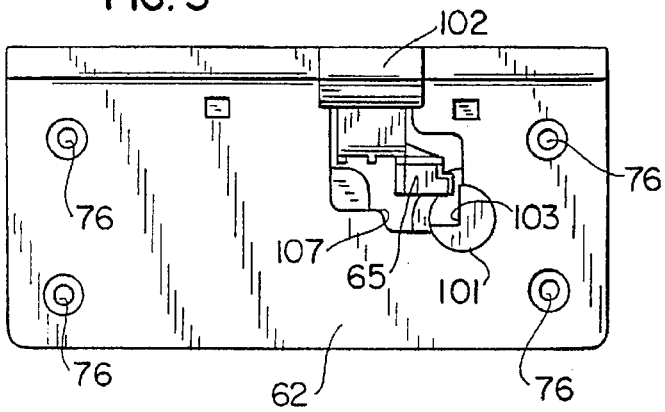
FIG. 4
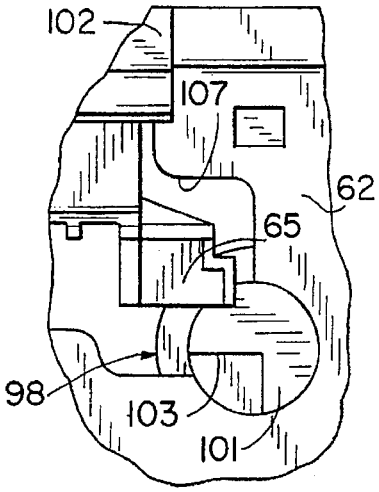
FIG. 5
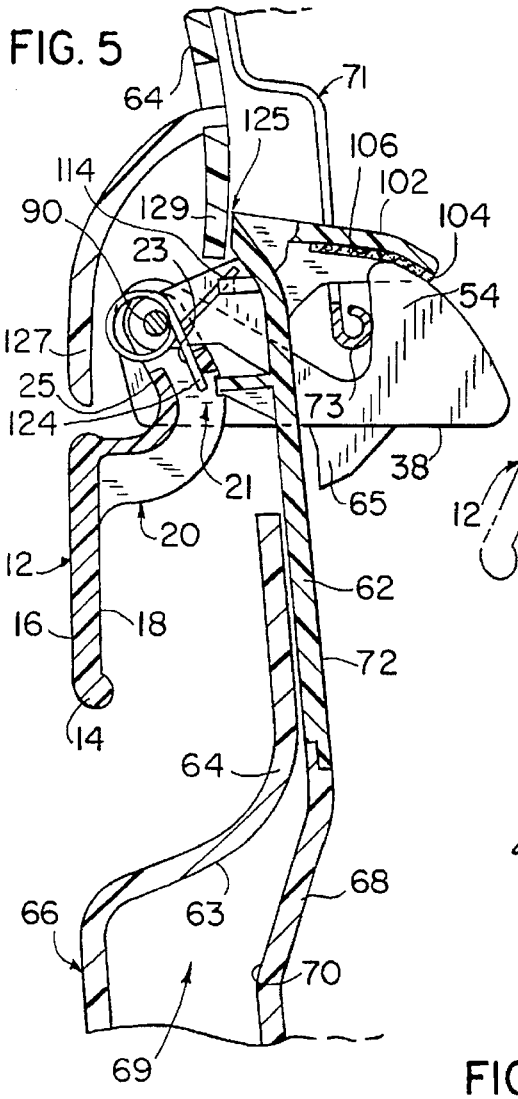
FIG. 6
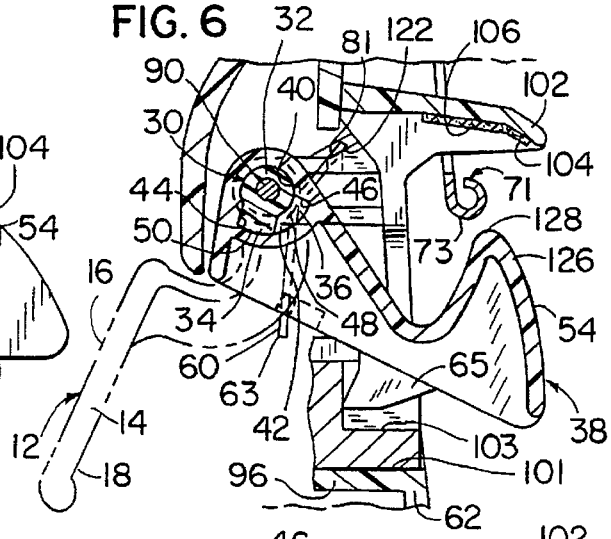
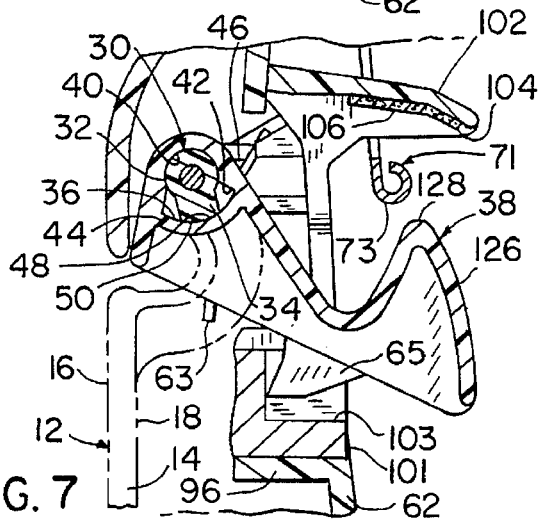
FIG. 7

GLOVE COMPARTMENT LATCH MECHANISM

BACKGROUND AND SUMMARY OF THE INVENTION

This invention related generally to a latch mechanism, and specifically to a latch mechanism for the glove compartment of an automobile, truck or the like.

It is customary to provide in the instrument panel structure of the front passenger compartment of an automobile, a compartment, usually called a glove compartment or a glove box. The glove compartment may be used to hold various items such as gloves, maps and the like. The door of the glove compartment is movable between a first closed position wherein access to the interior of the glove compartment is denied, and a second opened position wherein access the interior of the glove compartment is allowed.

The glove compartment door includes a latch mechanism which maintains the door of the glove compartment in the closed position, and which may be used to release the door of the glove compartment such that the door may be moved to the opened position. A lock may be incorporated into the latch mechanism to prevent the unauthorized opening of the glove compartment door. Heretofore, latches have taken on many different configurations. However, prior art plastic glove box mechanisms utilize many components, thereby resulting in a high assembly cost. As a result, it is highly desirable to manufacture a glove box latch mechanism which utilizes a minimal amount of component parts.

Therefore, it is a primary object and feature of the present invention to provide a glove box latch mechanism which has few component parts.

It is a further object and feature of the present invention to provide a glove box latch mechanism which is easy to assemble and to manufacture.

It is a still further object and feature of the present invention to provide a glove box latch mechanism which is easy to operate and inexpensive to manufacture.

A latch mechanism for a glove compartment is provided. The latch mechanism includes a plate mounted to a first panel of the glove compartment door. The plate includes first and second opposing sides and an opening extending therebetween. A latch handle is pivotally mounted to the plate for movement between the first opening position and a second closed position. A hook, interconnected to the latch handle, is also pivotally mounted to the plate. The hook is movable between a first position wherein a hook engages a striker element in the glove compartment and thereby maintains the glove compartment door closed, and a second position wherein the hook releases from the striker element thereby allowing the glove compartment door to be opened. Means are provided for biasing the outer end of the hook toward engagement of the striker element.

The latch mechanism of the present invention further includes a lock which prevents the unauthorized access to the interior of the glove compartment. When in the locked position, the lock cylinder prevents pivotable movement of the hook. When in the unlocked position, the hook may be pivoted so as to allow the hook to clear the striker element in response to pivoting the latch handle from the second closed position to the first opening position or in response to the closure of the glove compartment door.

An anti-tampering flange extends from the plate into the interior of the glove compartment so as to prevent an unauthorized person from inserting a tool between the glove compartment door and the frame work of the glove compartment so as to manipulate the hook and release the striker element. An anti-rattle pad is mounted to the lower surface of the anti-tampering flange so as to engage the radially outer end of the hook when the hook is engaging the striker element. The anti-rattle pad prevents rattling of the latch mechanism, as well as provide for quiet operation of the latch mechanism, i.e. dampening the noise when the hook contacts the anti-tampering flange.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 3 is a rear elevational view of a latch mechanism of the present invention;

FIG. 4 is a rear elevational of a portion of the latch mechanism of FIG. 3;

FIG. 5 is a cross-sectional view of FIG. 1 taken along line 5—5;

FIG. 6 is a cross-sectional view of the latch mechanism of FIG. 1 taken along line 6—6 showing the handle of the latch mechanism actuating the latch hook to an unlatched position; and FIG. 7 is a cross-sectional view of the latch mechanism of FIG. 1 taken along line 6—6 showing the latch hook in an unlatched position with the glove compartment door closed.

DETAILED DESCRIPTION OF THE ILLUSTRATED EMBODIMENT

Figures 1, 2:
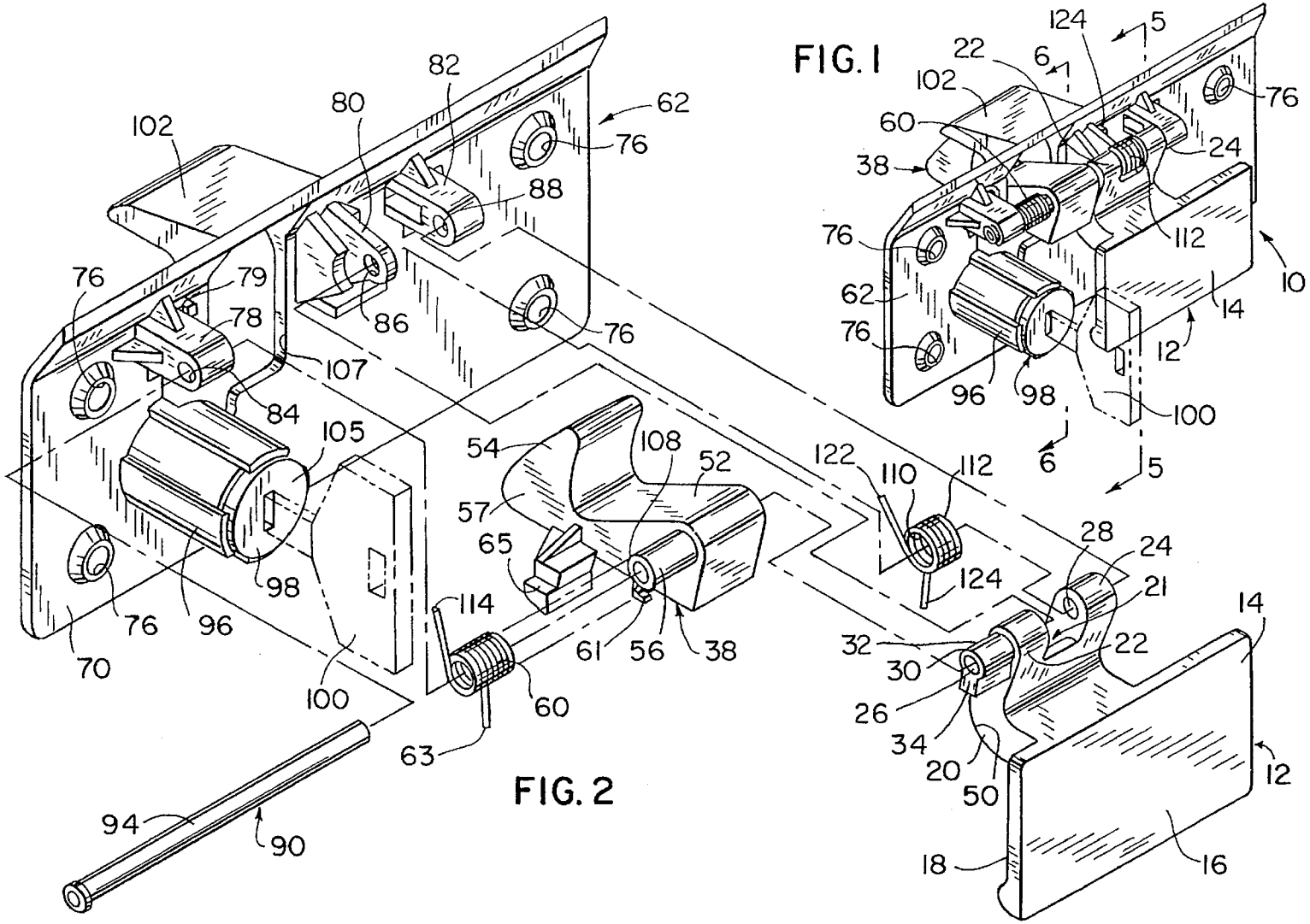
FIG. 1 is an isometric view of the latch mechanism of the present invention.
FIG. 2 is an exploded isometric view of the latch mechanism of the present invention.

The latch mechanism of the present invention is generally designated by the reference numeral 10. As best seen in FIG. 2, the latch mechanism 10 includes a latch handle 12 having a generally rectangular grasping portion 14 with a forward surface 16 and a rear surface 18. An arcuate flange 20 extends from the rear surface 18 of grasping portion 14. Flange 20 is generally hollow and includes a cavity 21, FIG. 5, therein defined by sidewalls 23 and 25. Flange 20 terminates with a pair of ears 22, 24 interconnected by sidewalls 23, 25. Each ear 22, 24 includes an opening 26 and 28, respectively, extending therethrough. Ear 22 further includes a key member 30 extending laterally therefrom away from ear 24.

Key member 30 includes a generally cylindrical head portion 32, through which opening 26 extends, and a flange portion 34 depending therefrom. Key member 30 is adapted for receipt inside a key member receipt cavity 36, FIGS. 6–7, formed in a latch hook 38.

Key member receipt cavity 36 includes a cylindrical head receipt portion 40 dimensioned for rotatably receiving the head portion 32 of key member 30 therein, so as to interlock latch handle 12 and latch hook 38. Key member receipt cavity 36 also includes a flange receipt portion 42 and is defined by sidewalls 44 and 46 and an arcuate surface 48 therebetween. Arcuate surface 48 has an arcuate length greater than the arcuate length of arcuate surface 50 along the bottom of flange portion 34 of key member 30.

Referring to FIG. 2, latch hook 38 also includes a base portion 52 and a hook portion 54. A neck 56 extends laterally from one side 57 of latch hook 38 for receipt of a torsion spring 60 thereabout. A shoulder 61 extends from side 57 of latch hook 38 such that a second end 63 of torsion spring 60 may be seated therein. A locking flange member 65 also extends from side 57 of latch hook 38, for reasons hereafter described.

A lock mechanism is designed for use in connection with a glove compartment door 66. Glove compartment door 66 is defined by a door outer 64 and a door inner 68 forming a cavity 69 therebetween. A generally U-shaped striker element 71 having a curled base 73 is connected within the glove compartment and depends therefrom.

A plastic plate 62 is interconnected to the inner surface 63 of door outer 64 of glove compartment door 66. Plate 62 includes first 70 and second 72 surfaces, and four mounting openings 76 therebetween for securing plate 62 to door outer 64. Plate 62 further includes first 78, second 80, and third 82 flanges extending from the first surface 70. Each flange 78, 80, 82 includes an opening 84, 86 and 88, respectively, therethrough for receipt of a shank 94 of a pivot pin 90. Flanges 78 and 80 each includes a groove 79, 81, respectively, for receiving one end of a respective torsion spring, as hereinafter described.

Plate 62 also includes a lock sleeve 96 extending from the first surface 70. Lock sleeve 96 is dimensioned for receipt of a standard lock cylinder 98 therein. As is conventional, lock cylinder 98 includes a mated key 100 used for locking and unlocking the latch mechanism 10 of the present invention. When the mated key 100 is inserted in the cylinder, the key 100 in the cylinder may be rotated from a locked position, as best seen in FIG. 4, to an unlocked position, as seen in FIG. 3. The rear surface 101 of the lock 98 includes a generally L-shaped depression 103 extending from the rear surface 101 toward the front surface 105 of lock cylinder 98.

Plate 62 further includes a anti-tampering flange 102 extending from the second surface 72 of plate member 62. Anti-tampering flange 102 includes an anti-rattle pad 104 affixed to the bottom surface 106 of anti-tampering flange 102. Anti-rattle pad 104 engages latch hook 38 when glove compartment door 66 is in the closed position and latch hook 38 is in the latched position, shown in FIG. 5.

In order to assemble latch mechanism 10, key member 30 of latch handle 12 is inserted into the key member receipt cavity 36 in latch hook 38 and the hook portion 52 of latch hook 38 is inserted through opening 107 in plate 62. The shank 94 of pivot pin 90 is slid axially through opening 84 in flange 78, through opening 108 in neck 56 of latch bolt 38 about which torsion spring 60 is positioned, through opening 26 in key member 30 and ear 22 of latch handle 12, through opening 86 in flange 80, through opening 110 in torsion spring 112, through opening 28 in ear 24 of latch handle 12, and into opening 88 in flange 82.

A first end 114 of torsion spring 60 is seated in a groove 79 in flange member 78, and, as previously described, second end 63 of torsion spring 60 is seated in a shoulder 61 extending laterally from the base 52 of latch bolt 38 so as to urge the hook portion 54 of latch hook 38 toward the latched position, as shown in FIG. 5.

Similarly, the first end 122 of torsion spring 112 is seated in groove 81 in flange 80, FIG. 6. The second end 124 of torsion spring 112 is positioned within a cavity 21 defined by sidewalls 23 and 25 of flange 20 such that end 124 of torsion spring 112 biases against sidewall 23 of flange 20 so as to urge latch handle 12 counterclockwise in FIGS. 5–6. As a result, the grasping portion 14 of latch handle 12 is urged to the closed position shown in FIGS. 1, 5.

In operation, lock cylinder 98 may be rotated between a locked position, as seen in FIG. 4, to an unlocked position, as seen in FIG. 3. When the cylinder lock 98 is in the locked position, locking flange member 65 engages rear surface 101 of lock cylinder 98 so as to prevent pivotal rotation of the hooked portion 54 of latch hook 38 about pivot pin 90. As seen in FIG. 3, when lock cylinder 98 is in the unlocked position, the L-shaped depression 103 in the rear surface 101 of cylinder lock 98 allows locking flange member 68 to pass past rear surface 101 of lock cylinder 98 when the hook portion 54 of latch hook 38 pivots about pivot pin 90.

When the lock cylinder 98 is in the locked position, and when the hook portion 54 of latch hook 58 is in the latched position, shown in FIG. 5, anti-tampering flange 102 prevents a thief from manipulating a tool through opening 125 between panel 62 and door outer 64 and thereafter disengaging the hook portion 54 from striker element 71. Further, a shield 127 extends from the outer surface 129 of door inner 64 so as to prevent a thief from gaining access to opening 125 and to prevent a user from placing a finger or the like in latch mechanism 10 and thereby hurting themselves.

When the hook portion 54 of latch hook 38 is in the latched position, as shown in FIG. 5, the hook portion 54 engages striker element 71 so as to prevent the opening of glove compartment door 66. In order to open glove compartment door 66, the grasping portion 14 of latch handle 12 may be lifted so as to pivot about pivot pin 90, FIG. 6. As latch handle 12 pivots about pivot pin 90, cylindrical head portion 32 of key member 30 rotates within cylindrical head receipt portion 40 of key member cavity 36 such that flange portion 34 of key member 30 engages sidewall 44 within latch hook 38 thereby pivoting hook portion 54 of latch hook 38 about pivot pin 90. As hook portion 54 of latch hook 38 pivots, counterclockwise in FIG. 6, about pivot pin 90, the hook portion moves to the unlatched position, FIG. 6, and releases from the striker element 71 thereby allowing the glove compartment door to be opened, or, in the alternative, to be closed if the glove compartment door is already opened.

Referring to FIG. 7, because the arcuate length of arcuate surface 48 in latch hook 38 is greater than the arcuate length of arcuate surface 50 along the bottom of flange portion 34 of key member 30, the hook portion 54 of latch hook 38 may pivot about pivot pin 90, FIG. 7, without any movement of latch handle 12. This allows the user to close glove compartment door 66 without lifting latch handle 12.

As glove compartment door 66 is closed, the outer surface 126 of hook portion 54 of latch hook 38 engages striker element 71 and urges hook portion 54 downward against the bias of torsion spring 60. Once striker element 71 has past the tip 128 of hook portion 54 of latch hook 38, torsion spring 60 biases the hook portion 54 of latch hook 38 back toward the latched position thereby recapturing striker element 71, FIG. 5, and maintaining glove compartment door 66 in the closed position.

Various modes of carrying out the invention are contemplated as being within the scope of the following claims particularly pointing out and distinctly claiming the subject matter which is regarded as the invention.

We claim:

1. A latch mechanism for a compartment, comprising:

a plate mountable to a door of the compartment, the plate having first and second opposing sides, and an opening extending therebetween;

a lever pivotably mounted to the plate for actuating the latch mechanism, the lever pivotable between a first latch opening position and a second latch closing position;

means for biasing the lever toward the latch closing position;

a hook pivotably mounted to the panel, the hook pivotable between a latched position and an unlatched position;

means for interlocking the lever and the hook such that the hook is pivotable from the latched to the unlatched position in response to the pivoting of the lever from the latch closing position to the latch opening position, and such that the hook pivots independent of the lever when the lever is in the latch closing position, wherein the means for interlocking the lever and the hook includes a key member extending laterally from the lever, the key member is receivable within the key receipt cavity in the hook and having a cylindrical head portion and a flange portion depending therefrom; and means for biasing the hook toward the latched position.

2. The latch mechanism of claim 1 wherein the plate includes a sleeve extending from the first side of the plate, the sleeve receiving a lock cylinder therein.

3. The latch mechanism of claim 2 wherein the lock cylinder is adapted for receiving a mated key therein, the lock cylinder and the mated key rotatable between a first locked position which maintains the hook in the latched position, and a second unlocked position which allows the hook to pivot to the unlatched position.

4. The latch mechanism of claim 1 wherein the means for biasing the lever toward the latch closing position includes a torsion spring.

5. The latch mechanism of claim 1 wherein the means for biasing the hook toward the latched position includes a torsion spring.

6. The latch mechanism of claim 1 further comprising an anti-tampering flange extending from the second side of the plate.

7. The latch mechanism of claim 6 wherein the anti-tampering flange including a lower surface having an anti-rattle pad mounted thereto, the anti-rattle pad engaging the hook when the hook is in the latched position.

8. The latch mechanism of claim 1 wherein the key receipt cavity in the hook includes a cylindrical key head receipt portion for receiving the cylindrical key head therein, and a flange receipt portion communicating with the cylindrical head key head receipt portion, the flange receipt portion receiving the flange portion of the key member therein.

9. A door for a compartment, comprising:

a plate mounted to a first panel of the glove compartment door, the plate including first and second opposing sides and an opening extending therebetween, a latch handle pivotably mounted to the plate for pivotal movement between a first open position and a second closed position;

a hook interlocked to the latch handle and pivotally mounted to the plate, the hook includes a radially outer end and is pivotable between a latched position and an unlatched position such that the hook pivots independent of the latch handle when latch handle is in the closed position and such that the hook pivots from the latched to the unlatched position in response to the pivoting of the latch handle from the closed to the open position;

a key member extending laterally from the latch handle, the key member receivable within the key receipt cavity in the hook and having a cylindrical head portion and a flange portion depending therefrom; and means for biasing the hook toward the latched position.

10. The compartment door of claim 9 further comprising a striker element mounted within compartment, the striker element engaging the hook when the hook is in the latched position.

11. The compartment door of claim 9 further comprising means for biasing the latch handle toward the closed position.

12. The compartment door of claim 11 wherein the means for biasing the latch handle toward the closed position includes a torsion spring.

13. The compartment door of claim 9 further comprising a means for maintaining the hook in the latched position.

14. The compartment door of claim 13 wherein the means for maintaining the hook in the latched position includes a sleeve extending from the first side of the plate and a lock cylinder received therein, the lock cylinder rotatable with a mated key between a first unlocked position which allows the hook to pivot, and a second locked position which maintains the hook in the latched position.

15. The compartment door of claim 9 further comprising an anti-tampering flange extending from the second side of the plate, the anti-tampering flange including a lower surface having an anti-rattle pad mounted thereto, the anti-rattle pad engaging the radially outer end of the hook when the hook is in the latched position.

16. The compartment door of claim 9 wherein the means for biasing the hook toward the latched position includes a torsion spring.

17. The compartment door of claim 9 wherein the key receipt cavity in the hook includes a cylindrical key head receipt portion for receiving the cylindrical key head therein, and a flange receipt portion communicating with the cylindrical head key head receipt portion, the flange receipt portion receiving the flange portion of the key member therein.

18. A latch mechanism for a compartment, comprising:

a plate mountable to a door of the compartment, the plate having first and second opposing sides, and an opening extending therebetween;

a lever pivotably mounted to the plate for actuating the latch mechanism, the lever pivotable between a first latch opening position and a second latch closing position;

means for biasing the lever toward the latch closing position;

a hook pivotably mounted to the panel, the hook pivotable between a latched position and an unlatched position;

means for interlocking the lever and the hook such that the hook is pivotable from the latched to the unlatched position in response to the pivoting of the lever from the latch closing position to the latch opening position, and such that the hook pivots independent of the lever when the lever is in the latch closing position;

means for biasing the hook toward the latched position;

a plurality of flanges extending from the first side of the plate, each flange including an opening extending therethrough, each opening in axial alignment with the other openings;

a pin extending through each opening in each flange and through the hook; and first and second ears extending from the lever, each ear including an opening for receiving the pin therethrough thereby allowing pivotable movement of the lever about the pin.

19. A latch mechanism for a compartment, comprising:

a plate mountable to a door of the compartment, the plate having first and second opposing sides, and an opening extending therebetween;

a lever pivotably mounted to the plate for actuating the latch mechanism, the lever pivotable between a first latch opening position and a second latch closing position;

means for biasing the lever toward the latch closing position;

a hook pivotably mounted to the panel, the hook pivotable between a latched position and an unlatched position;

means for interlocking the lever and the hook such that the hook is pivotable from the latched to the unlatched position in response to the pivoting of the lever from the latch closing position to the latch opening position, and such that the hook pivots independent of the lever when the lever is in the latch closing position, wherein the means for interlocking the lever and the hook includes a key member extending laterally from the lever, the key member receivable within the key receipt cavity in the hook;

means for biasing the hook toward the latched position;

a plurality of flanges extending from the first side of the plate, each flange including an opening extending therethrough, each opening in axial alignment with the other openings;

a pin extending through each opening in each flange and through the hook; and first and second ears extending from the lever, each ear including an opening for receiving the pin therethrough thereby allowing pivotable movement of the lever about the pin.

* * * * *